US006557797B1

(12) United States Patent
Bonamarte

(10) Patent No.: US 6,557,797 B1
(45) Date of Patent: May 6, 2003

(54) INTEGRAL TOILET PAPER ROLL AND SUPPORT SPINDLE

(76) Inventor: Stephen J. Bonamarte, 3100 Skokie Valley Rd., Suite 2N, Highland Park, IL (US) 60035

( * ) Notice: Subject to any disclaimer, the term of this patent is extended or adjusted under 35 U.S.C. 154(b) by 0 days.

(21) Appl. No.: 09/675,077

(22) Filed: Sep. 28, 2000

(51) Int. Cl.[7] ..... B65H 49/26

(52) U.S. Cl. ..... 242/599.4; 242/596.4; 242/596.7

(58) Field of Search ..... 242/599.1, 596, 242/596.4, 596.7, 598, 599, 599.4; 206/53, 54, 55, 403, 404, 405, 406

(56) References Cited

U.S. PATENT DOCUMENTS

| | | | | | |
|---|---|---|---|---|---|
| 498,900 | A | * | 6/1893 | Hicks | |
| 649,062 | A | | 5/1900 | Levett | |
| 1,098,862 | A | * | 6/1914 | Wheeler | |
| 1,480,927 | A | * | 1/1924 | Berger | |
| 1,552,082 | A | | 9/1925 | Riley | |
| 2,546,820 | A | | 3/1951 | Grant | |
| 2,639,939 | A | | 5/1953 | Matchett | 299/24 |
| 2,728,604 | A | | 12/1955 | Garfield | 299/24 |
| 2,873,928 | A | | 2/1959 | Klasky | |
| 2,935,270 | A | * | 5/1960 | Martin | |
| 3,002,704 | A | | 10/1961 | Grossfeld | |
| 3,051,404 | A | * | 8/1962 | Ritchey | |
| 3,329,367 | A | | 7/1967 | Paradiso | |
| 3,771,883 | A | | 11/1973 | Terepin | 401/123 |
| 3,910,229 | A | | 10/1975 | Spencer | 118/43 |
| 4,535,947 | A | * | 8/1985 | Hidle | |
| 4,564,148 | A | | 1/1986 | Wentworth | |
| 5,170,938 | A | | 12/1992 | Dewing | 239/52 |
| 5,322,234 | A | * | 6/1994 | Robert et al. | |
| 5,374,008 | A | * | 12/1994 | Halvorson et al. | |
| 5,381,984 | A | | 1/1995 | Hindsgual | 242/613.5 |
| 5,727,751 | A | * | 3/1998 | Liu | |
| 5,868,342 | A | * | 2/1999 | Moody et al. | 242/599.4 X |
| 5,951,762 | A | | 9/1999 | Shangold et al. | 118/405 |
| 6,016,900 | A | * | 1/2000 | Longrod | |
| 6,076,764 | A | * | 6/2000 | Robinson | |

* cited by examiner

*Primary Examiner*—William A. Rivera
(74) *Attorney, Agent, or Firm*—Welsh & Katz, Ltd.

(57) ABSTRACT

A method and apparatus for constructing an integral toilet paper roll and mounting spindle. The integral toilet paper roll and spindle includes a guide tube with the strip disposed around a longitudinal axis of the guide tube and a mounting peg moveably disposed within the guide tube and resiliently urged towards an engaged position. The integral toilet paper roll and spindle further includes a detent within the guide tube adapted to secure the mounting peg in a retracted position until the toilet paper roll is inserted into a toilet paper holder.

18 Claims, 2 Drawing Sheets

INTEGRAL TOILET PAPER ROLL AND SUPPORT SPINDLE

FIELD OF THE INVENTION

The field of the invention relates to toilet paper and more particularly to devices for mounting toilet paper rolls.

BACKGROUND OF THE INVENTION

Toilet paper rolls are well known and have assumed an almost universal appearance and structure. Typically, a new toilet paper roll is approximately 4-½ inches in diameter and 4-½ inches long. A center hole of approximately 1-½ inches is provided.

While the precise origins of the toilet paper roll are unknown, one historical view is that the toilet paper roll was originally intended for manual use (i.e., without a toilet paper holder). Accordingly, the size of the center hole (of 1-½ inches) was chosen to allow two forefingers of a user's hand to be inserted into the center hole, while the outer diameter was grasped with the user's thumb. By allowing the user a convenient method of holding the roll with one hand, the user's other hand was free to tear off individual sheets for use.

Under the historical view, the toilet paper holder was a later development directed to creating the appearance of a neater bathroom. However, even with this development, the overall appearance of the toilet paper roll has not changed even though toilet paper holders are in almost universal use.

While toilet paper holders do provide a neater bathroom and ostensibly allow one-handed use, a roll must still be replaced within the holder when the toilet paper is gone. To replace a toilet paper roll, a user must grasp and remove a center spindle. However, touching a center spindle (especially in a public bathroom) is abhorred by many people. Accordingly, a need exists for a better method of mounting toilet paper rolls.

SUMMARY

A method and apparatus are provided for constructing an integral toilet paper roll and support spindle. The integral toilet paper roll and spindle includes a guide tube with the strip disposed around a longitudinal axis of the guide tube and a mounting peg moveably disposed within the guide tube and resiliently urged towards an engaged position. The integral toilet paper roll and spindle further includes a detent within the guide tube adapted to secure the mounting peg in a retracted position until the toilet paper roll is inserted into a toilet paper holder.

DETAILED DESCRIPTION OF A PREFERRED EMBODIMENT

Figure 1:
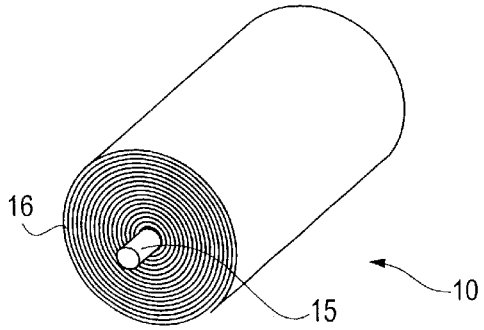
FIG. 1 is a perspective view of the integral toilet paper roll and spindle in accordance with an illustrated embodiment of the invention.
Figure 2:
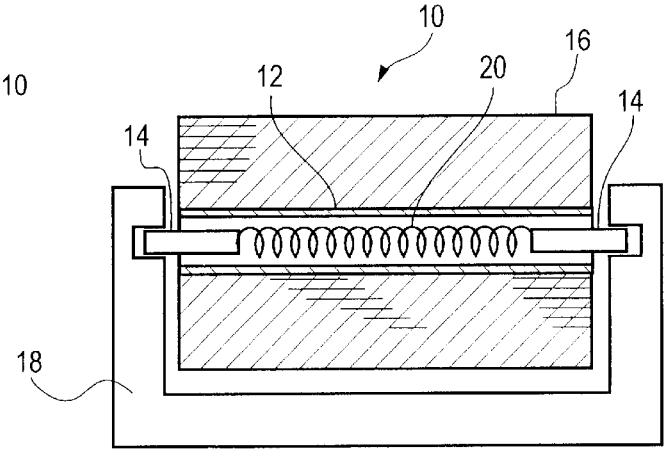
FIG. 2 is a cut-away view of the integral toilet paper roll and spindle of FIG. 1 connected to a toilet paper holder.

FIG. 1 is a perspective view of a toilet paper roll 10, generally in accordance with an illustrated embodiment of the invention. Under the illustrated embodiment, the roll 10 is fabricated with one or more mounting pegs 14 formed as an integral unit, which is specifically intended for use with a toilet paper holder 18 (FIG. 2). Since the roll 10 is intended for use with a toilet paper holder 18, there is no need to maintain the relatively large diameter center hole. Since there is no large center hole, the roll 10 inherently contains more toilet paper.

Under a first illustrated embodiment, a relatively slender, one-piece continuous rod 15 is provided which extends completely through the roll 10 and engages the toilet paper holder 18 on each end. The rod 15 may be either solid or tubular in cross section. An outer diameter of the rod may be of a relatively small diameter (e.g., less than ½ inch). The relatively slender rod forms a spindle which allows the toilet paper roll 10 to rotate in unison with the rod 15 as an integral unit.

Under the first embodiment, the paper 16 of the roll 10 is wound directly on top of the rod 15. The center rod 15 may be impregnated with a disinfectant. The roll 10 and center rod 15 may also be imbued with a fragrance.

Under a second illustrated embodiment, the rod 15 is divided into two relatively short pegs 14. A center guide tube 12 is provided to support the one or more mounting pegs 14 as shown in the cut-away view of the roll in FIG. 2. The mounting pegs 14 form spindles upon which the toilet paper roll may rotate during use.

Toilet paper 16 may be wound directly onto the tube 12. The center tube 12 may also be impregnated with a disinfectant 13 to further reduce any reticence a user may feel in removing an empty roll.

The tube 12 may be provided with a device 20 (e.g., spring) to resiliently urge the pegs 14 into an extended position as shown in FIG. 2. The tube 12 and pegs 14 may also be structured with a detent to retain the spring-loaded pegs 14 in a retracted position until inserted into a toilet paper holder.

Figure 3:
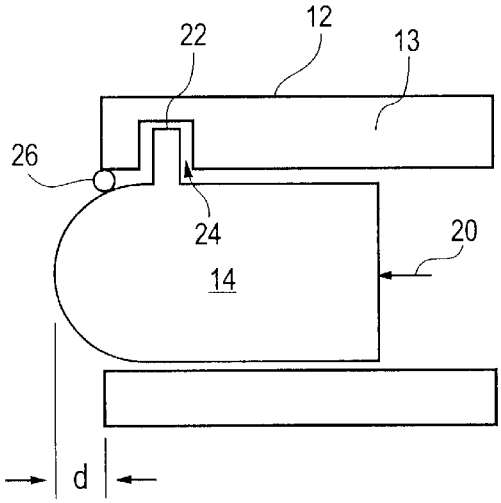
FIG. 3 depicts a mounting peg of the integral toilet paper roll and spindle of FIG. 1.

FIG. 3 shows a cut-away end portion of the tube 12 and peg 14. As shown, each peg 14 may be provided with a small tab 22, which engages a corresponding aperture 24 in the tube 12. The tab 22 may be structured to be easily broken off during insertion into the holder 18.

Figure 4:
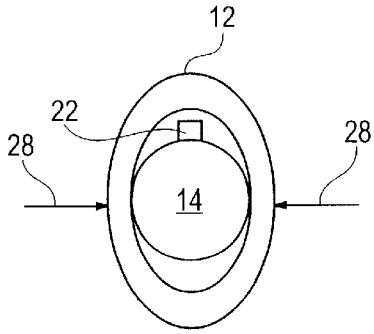
FIG. 4 depicts an assembly detail of the integral toilet paper roll and spindle of FIG. 1.

The tube 12 and pegs 14 may be fabricated of any appropriate mat erial (e.g., plastic) by an appropriate process (e.g., injection molding). The pegs 14 may be assembled into the tube 12 by fabricating the tube 12 with a slightly larger inner diameter than the outer diameter of the peg 14. By applying a side force 28 (FIG. 4), the tube 12 may be distorted sufficiently to allow the peg 14 and tab 22 to be inserted into the tube 12.

Once inserted into the tube 12, the peg 14 may be arranged to extend out of the tube 12 by a small distance "d" (FIG. 3). The exposure of the peg 14 by the distance "d"

allows the peg 14 to engage the holder 18 during insertion releasing the detent by breaking off the tab 22 and allowing the peg 14 to move to a fully extended position as shown in FIG. 2.

Under another illustrated embodiment of the invention, the detent may also be provided through the use of a small amount of glue (e.g., a thermoplast) 26. As above, insertion of the roll 10 into the holder 18 would be expected to release the glue 26.

Figure 5:
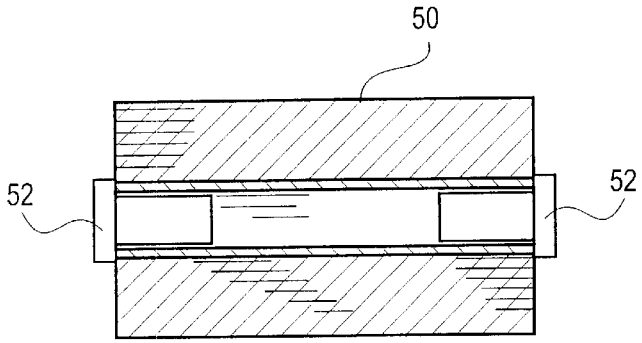
FIG. 5 depicts a cut-away view of the integral toilet paper roll and spindle of FIG. 1 under an alternate embodiment.
Figure 6:
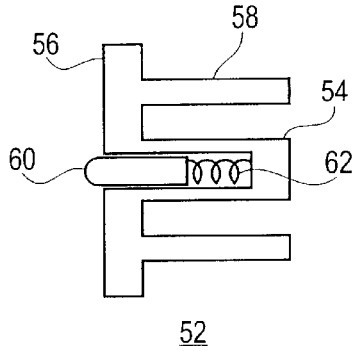
FIG. 6 depicts a detail of the integral toilet paper roll and spindle of FIG. 5.

Under another illustrated embodiment of the invention (FIG. 5), a conventional roll of toilet paper 50 may be assembled into the integral unit 10 of FIG. 1 through the use of end plugs 52. In the case of the end plugs 52, a center guide tube 54 may be configured to support a mounting peg 60 and spring 62. A detent may be provided for release of the peg 60 upon insertion of the roll into the holder.

A flange 56 may be formed on an end of the tube 54 to act as a stop upon insertion of the plug 52 into each end of the roll 50. A set of guides 58 may be formed on the flange 56 to engage the inside of the roll 50 and secure the plug 52 inside the roll 50. The entire plug 52 may be fabricated of an appropriate material (e.g., plastic).

Figure 7:
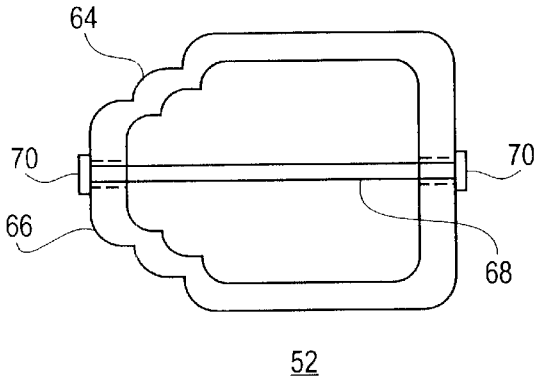
FIG. 7 depicts details of the integral toilet paper holder and spindle of FIG. 5 under an alternate embodiment.
Figure 8:
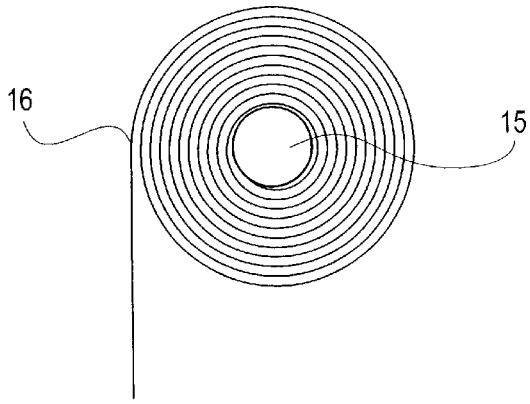
FIG. 8 is a side view of an integral toilet paper roll and spindle showing the toilet paper disposed directly onto and around the spindle in accordance with an illustrated embodiment of the invention.

In another embodiment of the invention (FIG. 7), the plug 52 may be fabricated of molded cardboard. Under the embodiment of FIG. 7, a set of corrugations 64 are formed on an engagement end of the plug 52 with each corrugation forming a connected annulate of progressively smaller diameter as it approaches the support peg 66.

A short filament 68 with cross pieces 70 on each end may be used to retain the peg 66 in a retracted position. When the plug 52 is inserted into the holder 18, the cross pieces shear off allowing the peg 66 to engage the mounting hole in the holder 18.

Under another illustrated embodiment, the ends of the spindle 14 are color coded to allow the toilet paper to flow off the top of the roll when inserted into the holder 18. To facilitate correct insertion into the holder, the right spindle is color coded red, and the left end is color coded blue.

A specific embodiment of a method and apparatus for constructing an integral toilet paper roll and spindle according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. An integral toilet paper roll and mounting spindle holding a strip of toilet paper, such toilet paper roll comprising:

a guide tube with the strip disposed around a longitudinal axis of the guide tube;

a mounting peg moveably disposed within the guide tube and resiliently urged towards an engaged position; and a detent within the guide tube adapted to secure the mounting peg in a retracted position until the toilet paper roll is inserted into a toilet paper holder.

2. The integral toilet paper roll and spindle as in claim 1 wherein the detent further comprises a tab.

3. The integral toilet paper roll and spindle as in claim 1 wherein the detent further comprises glue.

4. The integral toilet paper roll and spindle as in claim 1 wherein the detent further comprises a filament.

5. The integral toilet paper roll and spindle as in claim 1 wherein the guide tube further comprises an impregnated disinfectant.

6. The integral toilet paper roll and spindle as in claim 1 wherein the guide tube and mounting peg further comprise a predefined spatial relationship with the mounting peg extending partially out of the guide tube.

7. The integral toilet paper roll and spindle as in claim 1 wherein the tube further comprises a spring adapted to resiliently urge the mounting peg towards the engaged position.

8. A method of constructing an integral toilet paper roll and mounting spindle comprising the steps of:

providing a guide tube;

disposing toilet paper around the guide tube;

moveably disposing a first mounting peg inside the guide tube;

resiliently urging the mounting peg towards an extended position partially out of the guide tube; and restraining the mounting peg to a predetermined retracted position substantially inside the guide tube.

9. The method of constructing an integral toilet paper roll and spindle as in claim 8 wherein the step of resiliently urging the first mounting peg towards an extended position partially out of the guide tube further comprises providing a second mounting peg at opposing ends of the guide tube and a spring in between the first and second mounting pegs.

10. The method of constructing an integral toilet paper roll and spindle as in claim 9 further comprising providing a flange on an engagement end of the guide tube.

11. The method of constructing an integral toilet paper roll and spindle as in claim 8 further comprising inserting the guide tube into each end of a toilet paper roll as an end plug.

12. An integral toilet paper roll and mounting spindle comprising the steps of:

a guide tube;

toilet paper around the guide tube;

a first mounting peg moveably disposed inside the guide tube;

means for resiliently urging the mounting peg towards an extended position partially out of the guide tube; and means for restraining the mounting peg to a predetermined retracted position substantially inside the guide tube.

13. The integral toilet paper roll and spindle as in claim 12 wherein the means for resiliently urging the first mounting peg towards an extended position partially out of the guide tube further comprises providing a second mounting peg at an opposite ends of the guide tube.

14. The integral toilet paper roll and spindle as in claim 13 wherein the means for resiliently urging the first mounting peg towards an extended position partially out of the guide tube further comprises a spring disposed between the first and second mounting pegs.

15. The integral toilet paper roll and spindle as in claim 12 further comprising means for inserting the guide tube into each end of a toilet paper roll.

16. An integral toilet paper roll and mounting spindle comprising:

a guide tube;

toilet paper around the guide tube;

a first mounting peg moveably disposed inside the guide tube;

a resilient device adapted to resiliently urge the mounting peg towards an extended position partially out of the guide tube; and a detent adapted to restrain the mounting peg to a predetermined retracted position substantially inside the guide tube.

17. The integral toilet paper roll and spindle as in claim 16 wherein the resilient device further comprises a spring.

18. The integral toilet paper roll and spindle as in claim 16 further comprising a color coding disposed on the first mounting peg to identify the first mounting peg as either a right or left mounting peg.

* * * * *